US006387244B1

(12) United States Patent
Lyublinski

(10) Patent No.: US 6,387,244 B1
(45) Date of Patent: May 14, 2002

(54) CATHODIC PROTECTION OF REINFORCED CONCRETE WITH IMPREGNATED CORROSION INHIBITOR

(75) Inventor: Efim Ya. Lyublinski, Mayfield, OH (US)

(73) Assignee: COR/SCI, LLC., Cleveland, OH (US)

( * ) Notice: Subject to any disclaimer, the term of this patent is extended or adjusted under 35 U.S.C. 154(b) by 0 days.

(21) Appl. No.: 09/761,387

(22) Filed: Jan. 16, 2001

Related U.S. Application Data

(60) Provisional application No. 60/241,225, filed on Oct. 18, 2000.

(51) Int. Cl.[7] ..... C23F 13/00
(52) U.S. Cl. ..... 205/734
(58) Field of Search ..... 205/734

(56) References Cited

U.S. PATENT DOCUMENTS 5,141,607 A 8/1992 Swiat ..... 204/147
5,225,058 A * 7/1993 Bazzoni et al. ..... 204/196.37
5,228,959 A * 7/1993 Miller ..... 205/734
5,368,709 A * 11/1994 Utklev ..... 204/182.2
6,238,545 B1 * 5/2001 Allebach et al. ..... 205/734
6,270,643 B1 * 8/2001 Finnebraaten ..... 204/515

* cited by examiner

*Primary Examiner*—Bruce F. Bell

(57) ABSTRACT

A steel-reinforced structure supplied with an aqueous solution of an inhibitor for the strucutre, is further protected against deterioration when an impressed cathodic current is applied; preferably the structure is continuously bathed in the inhibitor solution; flow of the first impressed current is maintained until flow is relatively constant at a level at least one-half the level at which the first impressed current was initiated. The concentration of ions is sensed by measurement of the current flow while maintaining a chosen voltage. The inhibitor solution may be used in conjunction with an electroosmotic current to drive ions into the concrete and towards the steel; this may be done prior to applying the cathodic impressed current, or concurrently therewith by providing secondary electrodes. Program controller means in the power station switches from one mode of delivery to another when current usage, measured by current density, is deemd to have become uneconomical.

6 Claims, 2 Drawing Sheets

CATHODIC PROTECTION OF REINFORCED CONCRETE WITH IMPREGNATED CORROSION INHIBITOR

This application claims the benefit of Provisional Application No. 60/241,225 filed Oct. 18, 2000.

BACKGROUND OF THE INVENTION

Intermittent or continuous methods of inhibiting the corrosion of steel contained in concrete structures are described. The equipment necessary to effect these methods can be incorporated into the structure during construction or retrofitted to existing structures. Cathodic protection systems are routinely used in the art, and it is known that impregnated corrosion inhibitors are effective to slow the damage due to corrosion by exposure to the atmosphere, but the unexpectedly beneficial effect of combining the two technologies was not known.

This application is directed to a system for combining delivery of corrosion inhibitors with the cathodic protection of reinforcing concrete members referred to as "rebars" in conventionally reinforced concrete structures. Such rebars are produced from mild steel (also referred to as "black steel") which has less than 1% carbon and less than 2% of alloying elements, combined. More particularly the invention teaches several methods of providing desirable corrosion protection with cathodic protection which may be immediately commenced on newly embedded rebars in reinforced and/or prestressed concrete structures, that is, structures such as bridges, buildings including power stations, marine structures such as docks, and roadways which are yet to be built; or, the system may be used on aging reinforced concrete structures contaminated with salts formed by reaction of the concrete with atmospheric pollutants.

A system is provided for controlling corrosion of steel-reinforced concrete which is contaminated by sulfur oxides, nitrogen oxides, hydrogen sulfide, chlorides and carbonates, and road treatment salts such as sodium chloride and potassium chloride, all of which permeate the concrete structure and attack the steel rebars. This invention combines impregnating the surface of a concrete structure with an inhibitor using an electrical driving force, and thereafter cathodically protecting the structure either with a sacrificial anode, or, with an impressed current. For even better protection, a heavily contaminated structure is cleansed with an electroosmotic treatment which removes detrimental anions in the concrete. With the corrosivity of the environment surrounding the steel greatly diminished due to the electroosmotic treatment, subsequent impregnation with a corrosion inhibitor and using an impressed cathodic current as needed, is found to be more economical than using any of the processes separately.

The inhibitor used may be any one of the compounds known to be effective to inhibit the corrosion of steel in concrete. Such compounds are disclosed in "Cement," Encyclopedia of Chemical Technology (Kirk-Othmer; eds, John Wiley & Sons, Inc., NY, N.Y., 5th ed., 1993) vol. 5, pp. 564–598; ACI Manual of Concrete Practice, Part 1—1995 (American Concrete Institute, Detroit, Mich. 48219); Encyclopedia of Polymer Science and Technology, vol. 10, pp. 597–615 (John Wiley & Sons, NY, N.Y. 1969) and other texts. Commonly used are inorganic nitrites such as calcium nitrite which may contain minor amounts of sodium nitrite; calcium formate and sodium nitrite, optionally with triethanolamine or sodium benzoate; inorganic nitrite and an ester of phosphoric acid and/or an ester of boric acid; an oil-in-water emulsion wherein the oil phase comprises an unsaturated fatty acid ester and ethoxylated nonyl phenol and the ester of an aliphatic carboxylic acid with a mono-, di- or trihydric alcohol and the water phase comprises a saturated fatty acid, an amphoteric compound, a glycol and a soap; amidoamines which are oligomeric polyamides having primary amine functionality and which are the reaction product of polyalkylenepolyamines and short-chain alkanedioic acids or reactive derivatives thereof; etc. Most preferably the inhibitor is ionizable in aqueous solution, but organic compounds which are not ionizable may also be used in combination with an electrolyte which will "carry" the inhibitor into the concrete.

To provide a basis for comparing the effect of combining processes in which the conditions are different, efficiency of the processes to combat corrosion is used as a common parameter. "Efficiency" is stated as being zero when there is no protection of any kind; efficiency is defined as the amount of metal which was not lost because of protection, divided by the amount of metal which would be lost with no protection, or:

(corrosion rate with no protection)–(corrosion rate with protection) divided by (corrosion rate with no protection).

The following terms are used in this disclosure:

"$E_c$" refers to the corrosion potential of the rebar. $E_c$ is measured with a reference electrode placed in contact with the circumferential surface of the concrete sample. It is written negative relative to a standard hydrogen electrode.

"$E_p$" refers to the potential at which an effective impressed current for cathodic protection is to be supplied.

"CD": current density=current divided by the superficial area of the rebar in contact with concrete.

"CP": impressed current for cathodic protection, identified separately when different.

"EP-1" and "EP-2": direct current provided in separate circuits for electroosmotic treatment; EP-1 removes contaminant anions from the concrete, EP-2 delivers inhibitor cations to the reinforcing members.

"EL" refers to electrolyte in which samples are immersed—the specific electrolyte, and the sequence in which it is used is specified in each example. EL-1 refers to an aggressive saline solution; EL-2 refers to a solution of a known corrosion inhibitor.

SUMMARY OF THE INVENTION

It has been discovered that a steel-reinforced structure is protected against deterioration when a first cathodic impressed current (CP-1) is applied between a primary anode disposed adjacent an outer surface of the reinforced concrete, and, the steel of the structure, at a potential in the range from 50 mV to about 350 mV numerically greater than the corrosion potential $E_c$ measured; the steel functions as a primary cathode; the structure is substantially saturated with a solution of a corrosion inhibitor; preferably the structure is continuously bathed in the inhibitor solution; flow of the first impressed current is maintained until flow is relatively constant at a level at least one-half the level at which the first impressed current was initiated. A reference electrode is used to indicate the corrosion potential at the rebars. The concentration of ions is sensed by measurement of the current flow while maintaining a chosen voltage.

Excellent protection against deterioration of the concrete structure is also provided with a secondary cathode and a secondary anode, both adjacent but exteriorly disposed relative to the structure, allowing a direct first electroosmotic current and an impressed cathodic current to be applied concurrently; the direct first electroosmotic current is applied at a chosen voltage non-injurious to humans, between the secondary electrodes, at a level sufficient to drive cations or anions of the inhibitor into the concrete; when flow of the first electroosmotic current decreases at least by one-half, the direct impressed cathodic current is applied. If desired, the first electroosmotic current may then be switched off (when it decreases at least by one-half) and then the direct impressed cathodic current is applied.

For badly contaminated structures, prior to applying the direct first electroosmotic current, a direct second electroosmotic current between the secondary electrodes is applied at a chosen third voltage non-injurious to humans, at a level sufficient to remove contaminant anions in the concrete; the second electroosmotic current is maintained at essentially constant voltage until its flow decreases by least by one-half.

It is therefore a general object of this invention to provide a cathodic protection system which may be used in combination with an impregnation system for impregnating a corrosion inhibitor, either successively, or essentially concurrently; for even better corrosion protection, the foregoing systems may be preceded by electroosmotic treatment, or, if the economics justify doing so, may be used essentially concurrently with a set of secondary electrodes.

When an impressed current is used, a determination that the current density is too high to be economical, results in a control system making the electrical connection between the secondary electrodes. When the sensing means senses that the concentration of inhibitor corresponding to a measured current density is sufficiently low, the supplemental anode is disconnected. If a sacrificial anode is used for cathodic protection, the galvanic circuit with the rebars is reestablished. If desired, the galvanic circuit with the rebars and anode, whether sacrificial or inert, may be maintained while the concrete is being impregnated with inhibitor.

If the concrete structure is heavily contaminated, electroosmotic treatment is commenced before impregnation with inhibitor. The circuit for electroosmosis is turned off when the concentration of salts is sensed to have dropped to a low enough level that an impressed cathodic current may be turned on and maintained at a certain level, typically in the range from about 150 mV to less than 300 mV lower than the corrosion potential of the rebars until the current density rises to more than 100 mA/m$^2$. The impressed current may then be turned off. Control of the system is effected with a programmable control means associated with the power source.

BRIEF DESCRIPTION OF THE DRAWING

The foregoing and additional objects and advantages of the invention will best be understood by reference to the following detailed description, accompanied with schematic illustrations of preferred embodiments of the invention, in which illustrations like reference numerals refer to like elements, and in which:

FIG. 1(*b*) schematically illustrates an inhibitor impregnation system in combination with a sacrificial anode cathodic protection system with the sacrificial anode buried in the ground proximate but outside the concrete structure.

DETAILED DESCRIPTION OF PREFERRED EMBODIMENTS

Aluminum or aluminum-rich alloy rods, or magnesium and magnesium-rich alloy rods, zinc and zinc-rich alloys were used as sacrificial anodes proximately disposed or embedded within the structure in galvanic connection with the steel rebars; or zinc-coated rebars were used; in either case, the required mass of the anode is the amount of metal which goes into solution over time, this amount of metal being the amount of electricity flowing through the galvanic circuit and the time over which the metal is consumed (Faraday's law). Since protection is sought over an extended time, and the rate of consumption of the anode is typically quite high once corrosion commences, the required mass of sacrificial anode for the long period, say 100 years, is high. Moreover, periodic replacement of anodes to provide continuous protection is inconvenient at best and often impractical. Therefore use of such sacrificial anodes has been largely discontinued in favor of using an external power supply to provide an impressed cathodic current to the corrodible metal. By controlling the impressed current the service life of the structure is not limited by corrosion of its steel reinforcement.

In cathodic protection, an impressed current is caused to flow through the anode into the electrolyte and then to the rebars in the structure. Such protection with the steel rebars as the cathode, as conventionally practiced, is expensive, requiring a much higher current density to obtain a satisfactorily low level of corrosion than that required to obtain the same corrosion protection with rebars in an environment which has been depleted of corrosive ions, but not to so great an extent that the current required for impressed current cathodic protection is too high, that is, requiring a current density greater than about 100 mA/m$^2$.

Figure 1A:
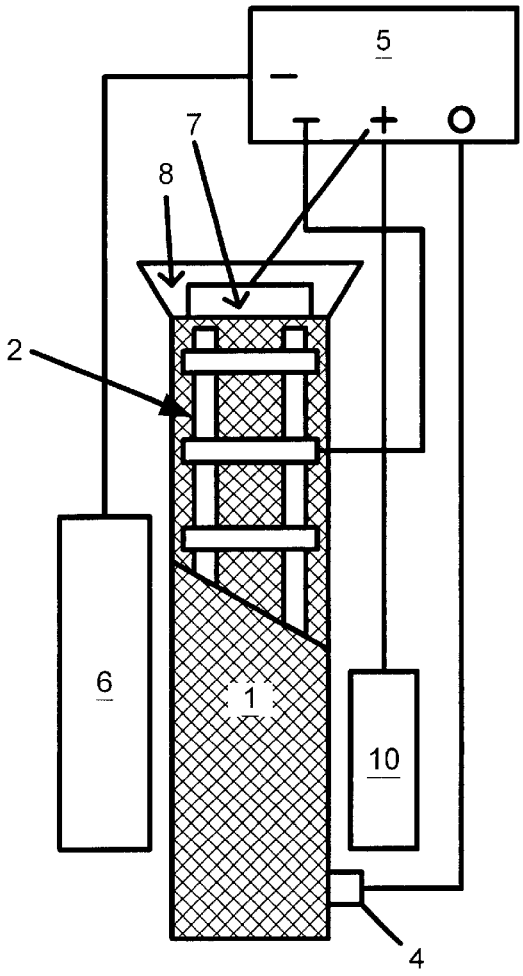
FIG. 1(*a*) schematically illustrates an inhibitor impregnation system in combination with a cathodic protection system with impressed current with the inert anode buried in the ground proximate but outside the concrete structure.
Figure 1B:
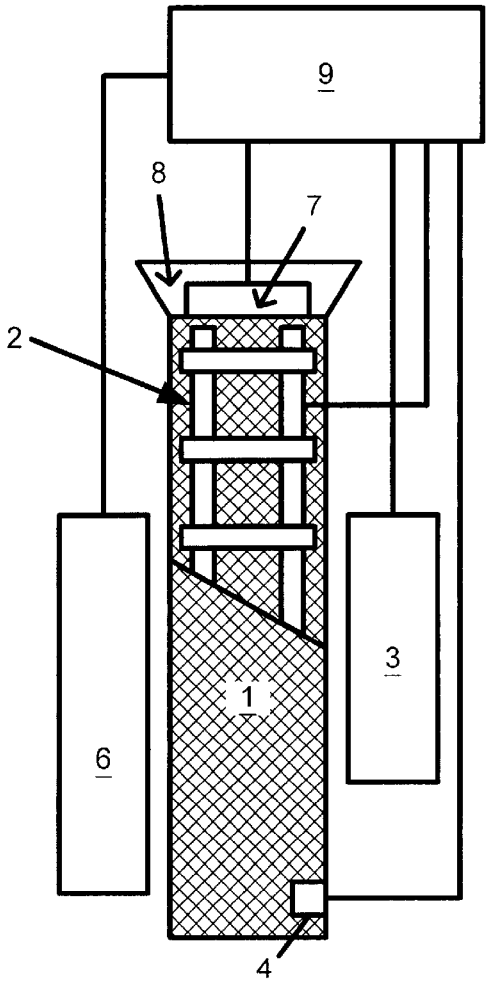

Referring to FIG. 1(*a*) there is schematically illustrated a column of reinforced concrete 1, reinforced with a grid of rebars 2, to the periphery of which column is fitted a reservoir 8 of an inhibitor solution, so that the solution seeps through and saturates the column. Alternatively, the column may be jacketed as disclosed in U.S. Pat. No. 5,141,607 to Swiat. A secondary anode 7 is placed in the inhibitor solution 8 and a secondary cathode 6 is placed adjacent the column which is positioned between the secondary electrodes to allow flow of electroosmotic current through the column 1. A conventional impressed current circuit is provided with a primary inert anode 10 and primary cathode 2 (rebars) which are connected to power supply 5, typically a rectifier, to deliver direct current. The secondary electrodes, when in use, are also powered by the power supply 5. A reference electrode 4 provides readings of the corrosion potential at the rebars. A programmable control means associated with the source of power monitors and is responsive to changes in current usage, measured as current density, and indicated by measurements of current flow. Measurements provide data as to the corrosion potential $E_c$ at the rebars, the pH of the concrete and the concentration of salts at different locations within the column.

When current flows through the secondary electrodes 6 and 7 cations or anions of corrosion inhibitor are urged into the concrete. Typically, secondary cathode 6 is placed in contact with the column and is wetted with solution and cations from the solution migrate through the column towards the secondary cathode 6. When the concentration of inhibitor reaches a predetermined level, the supplementary anode is disconnected. The concentration of inhibitor is sufficient to allow a relatively low current density of impressed current to be highly effective. Therefore the impressed current is turned on with the rebars cathodically connected in a conventional manner, and the current maintained until the current density exceeds a predetermined level, typically 200 $mA/m^2$, preferably 100 $mA/m^2$.

In another embodiment, the corrosion inhibitor is impregnated essentially concurrently with the impressed cathodic current.

The secondary electrodes provide a dual function—they may be used to remove corrosive species such as $Cl^-$, $CO_3^{=}$, $SO_4^{=}$ and sulfite from the bulk of the reinforced concrete by using an externally applied current between an exterior cathode and an exterior anode for electroosmotic polarization; or they may be used to impregnate inhibitor ions into the concrete. Inhibitor may also be supplied to the concrete by diffusion only.

Referring to FIG. 1(*b*) the cathodic protection system utilizes a sacrificial anode 3, and as before, the concrete column 1, reinforced with a grid of rebars 2, is provided with a container 8 of a solution of an inhibitor for reinforced concrete; and, as before secondary electrodes 6 and 7 are electrically connected to a control system 9, and a reference electrode 4 provides measurements of $E_c$. The control system is responsive to changes in current density.

Experimental Procedure

Numbered samples of reinforced concrete cylinders having a diameter of 10 cm and a height of 15 cm, are prepared using 300 Kg of Portland cement per cubic meter of concrete. In the center of each cylinder is longitudinally anally embedded a clean rust-free carbon steel rod 1.0 cm in diameter and 15 cm long. The weight of each rebar in each of the samples was recorded before it was embedded in the sample. After a run, each sample was fractured and the rebar recovered, cleaned and re-weighed. Also embedded in each sample, proximate to the central rod, is a pH electrode to monitor the pH as a function of time. After each run, the top of each rebar, which provides electrical connection as a second cathode, is cut off essentially flush with the top of the concrete to minimize the error due to corrosion of the top portion being exposed directly to the corrosive elements in the conditioning chamber without benefit of being covered by concrete.

To accelerate atmospheric damage which normally would be expected to occur over a period of decades, all the samples are pre-conditioned over a period of 30 days in a conditioning chamber provided with an aggressive synthetic atmosphere. All samples tested were first conditioned in the conditioning chamber. The atmosphere in the conditioning chamber has the following composition:

| | |
|---|---|
| chloride, $Cl^-$: | 1.5 $g/m^2 \times h$ (measured on the surface of the cylinder) |
| sulfur dioxide $SO_2$: | 30 $mg/m^3$ |
| relative humidity, RH: | 100% |
| chamber temperature: | 55° C. |

The effect of aging in the conditioning chamber is assessed by measuring pH as a function of time in each of the samples, which pH is found to vary in the ranges given, from sample to sample, during each period in the ranges set forth as follows in Table 1 below:

TABLE 1

| Day # | 1 | 10 | 20 | 30 |
|---|---|---|---|---|
| pH | 12.0–13.4 | 7.6–9.1 | 7.4–8.3 | 6.8–8.0 |

Samples are thereafter tested to determine the corrosive effect of the highly aggressive but substantially pH neutral, saline solution EL-1, under specified protective conditions, by immersing them in the solution. EL-1 is prepared by dissolving the following salts in distilled water; their concentrations in EL-1, given as g/L, are NaCl, 25; $MgCl_2$, 2.5; $CaCl_2$, 1.5; $Na_2SO_4$, 3.4; and $CaCO_3$, 0.1.

Figure 2:
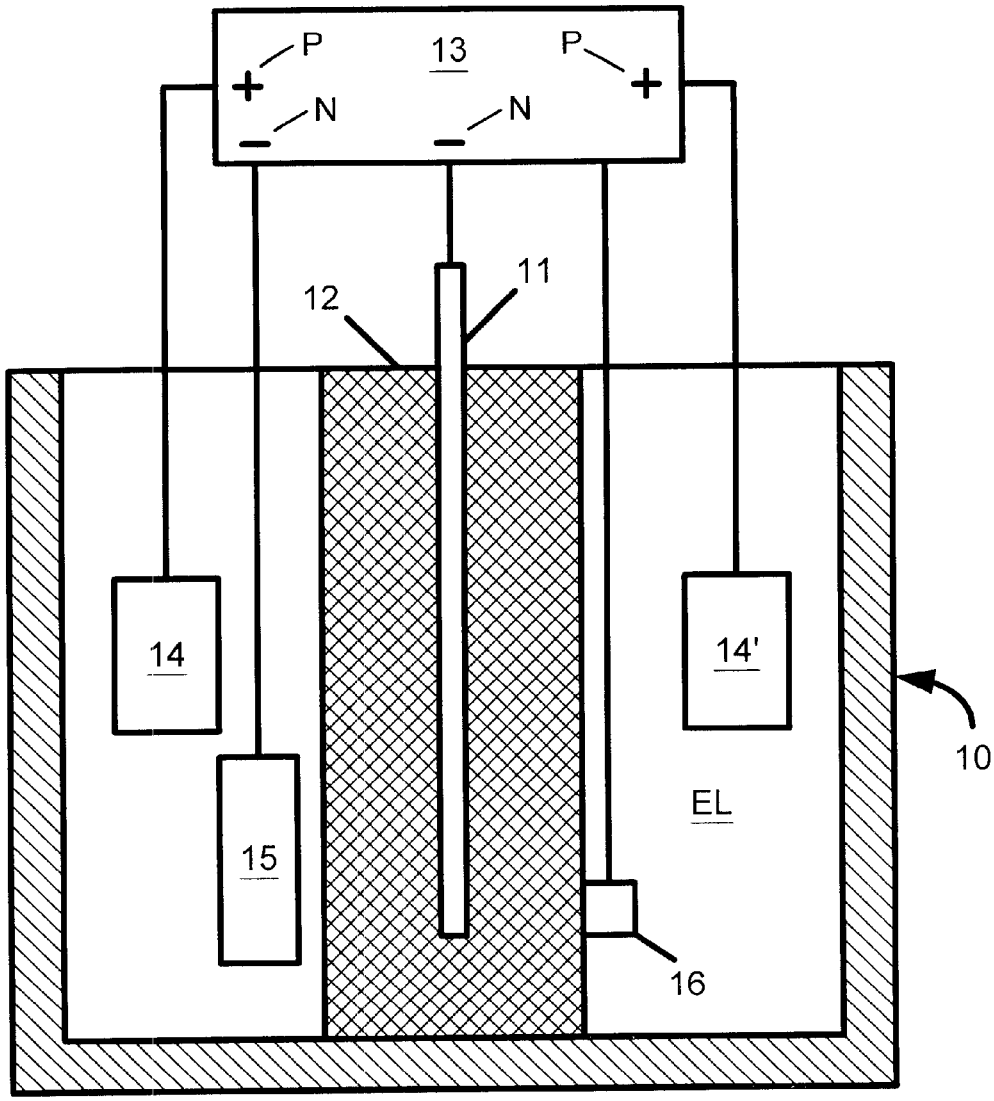
FIG. 2 graphically illustrates the apparatus in which samples of concrete were tested.

Referring to FIG. 2 there is illustrated an electrically non-conductive plastic container 10 filled with electrolyte EL-1 in which a conditioned reinforced concrete sample 12 is centrally disposed with the top of rebar 11 protruding from the upper surface of the sample. The rebar 11 functions as a cathode (referred to herein as the "second" cathode) and is connected to the negative terminal N in a power station 13. Anode 14 is suspended, spaced apart from the concrete surface and connected to positive terminal P in the power station 13 to complete the circuit with 11. Though a single anode is shown, multiple anodes may be used. Anode 14' is suspended in EL-1 and connected to a separate positive terminal P' in the power station 13. Another cathode 15 (referred to as "first") is suspended in the electrolyte, spaced apart from the surface of the sample, and connected to negative terminal N' in the power station 13.

Each pair of terminals provides current for circuits which serve different purposes, one for cathodic protection with impressed current CP, and the other for electroosmotic treatment, for the dual purposes of both (i) removing corrosive anions from the concrete with a "first direct current" EP-1, and, (ii) driving inhibitor cations into the concrete with a "second direct current" EP-2.

A reference electrode 16 is placed in contact with the circumferential surface of the sample to measure $E_c$. After only three days $E_c$ is difficult to measure meaningfully but after about 10 days it is found to be about 360 mV and remains substantially constant irrespective of in which sample the rebar is embedded.

In a first series of experiments, the corrosive effect of the electrolyte EL-1 on a statistically significant number of samples is measured at the end of 180 days in the container 10. There is no protection against corrosion by the saline electrolyte EL-1 in which each sample is immersed; $E_c$ is measured every day. The corrosive effect is measured by removing a sample at the end of the specified 180 day period, fracturing it sufficiently to remove the rebar, then cleaning the rebar to remove all adhering concrete and rust. The cleaned rebar is then weighed and the weight loss computed. Knowing the circumferential area of the clean rebar and adding the circular area of its bottom surface 1.5 cm in diameter, the weight loss per $cm^2$ is computed. Then, taking the density of steel as 7.9 g/cc, and knowing the period over which the corrosion occurred, the corrosion rate is computed and given as the thickness of metal lost, $\mu$m/year.

The results are set forth in Table 2 below:

TABLE 2 corrosion rate with no protection

| Day, # | $-E_c$ (mV) | Corrosion Rate μm/year | Efficiency |
|---|---|---|---|
| 180 | 360 | 190 | 0 |

As might be expected, the corrosion rate appears to have reached a substantially constant average of about 190 μm/year.

In the second series of experiments, the effectiveness of three illustrative corrosion inhibitors, each used by itself with no current applied, was measured after the samples had been immersed in the inhibitor solutions for 180 days so the concrete was saturated with inhibitor solution. $E_c$ was measured every day. Delivery of inhibitor was by diffusion only, no current EP-1 being supplied. The results are set forth in Table 3 below:

TABLE 3 corrosion rate w/inhibitor, no EP-1 current, no cathodic protection

| Ident. | Conc. mg/L | Corr. rate μm/year | Eff. % |
|---|---|---|---|
| $A^1$ | 10 | 142 | 22 |
| $A^1$ | 100 | 85 | 55 |
| $B^2$ | 15 | 154 | 19 |
| $B^2$ | 130 | 66 | 66 |
| $C^3$ | 15 | 131 | 26 |
| $C^3$ | 130 | 57 | 70 |

$A^1$ is an equimolar mixture of $ZnSO_4$ and $NaH_2PO_4$
$B^2$ is an organic nitrite
$C^3$ is an organic aminophosphite In the third series of experiments, the corrosion rate was measured for conventionally cathodically protected preconditioned (contaminated) samples at the end of a 180 day period which were saturated with EL-1. The samples were not treated with any inhibitor, and had no protection other than that provided by a first impressed current CP-1 at several different current densities. The results are set forth in Table 4 below:

TABLE 4 corrosion rate with no inhibitor, and CP-1 only

| Day # | CD $mA/m^2$ | Corr. rate μm/year | Eff. % |
|---|---|---|---|
| 180 | 15 | 138 | 25 |
| 180 | 120 | 48 | 75 |
| 180 | 195 | 10 | 95 |

As might be expected, better protection is afforded at higher current densities, but even at a current density of 120 $mA/m^2$ the efficiency is only 75%.

In the fourth series of experiments, the corrosion rate was measured at the end of a 180 day period, and also at several points during the period, on several preconditioned samples immersed in saline EL-1 to determine the corrosion protection afforded by only electroosmotic treatment with direct current EP-1 at 36 V, used to remove contaminant anions. The results are set forth in Table 5 below:

TABLE 5 corrosion rates with EP-1 only, no inhibitor, no cathodic protection

| Day # | EP-1 μA | Corr rate μm/year | Eff. % |
|---|---|---|---|
| 1 | 700–800 | 165 | 25 |
| 5 | 300–400 | 105 | 52 |
| 10 | 100–200 | 70 | 68 |
| 180 | 50–100 | 45 | 79 |

It is evident that, as the contaminant anions leave the concrete and its resistivity increases, the flow of EP-1 current diminishes while the corrosion rate decreases and efficiency increases. Note that after 10 days of EP-1 treatment the corrosion rate is 70 μA/yr and the efficiency is 68%.

In the fifth series of experiments, the corrosion rate was measured at the end of a 180 day period, on samples immersed in EL-1 which had first been electroosmotically treated with EP-1 to remove anions; the EL-1 was replaced with inhibitor solution EL-2 having the stated concentration. Inhibitor cations are then driven into the concrete with EP-2 current at 36 V. EP is measured as $mA/Mcm^3$ (milliamps/1000 $cm^3$ of concrete).

EXAMPLE 1

In a first embodiment of the invention, the effect of combining inhibitor impregnation only by natural diffusion, with impressed current CP-2, but no electroosmotic current EP-2, is evaluated in preconditioned samples taken out of the chamber and treated as follows:

1. The samples are immersed in inhibitor EL-2 having the stated concentration.
2. $E_c$ is measured every day and direct current CP-2 is turned on when $E_c$ could be measured.
3. After CP-2 decreased by a factor of 8 it remained relatively constant.
4. Additional inhibitor solution EL-2 was charged to the container when CP-2 was found to have doubled. The frequency with which EL-2 is replenished depends upon how long it takes for CP-2 to double.
5. The potential $E_p$ of CP-2 was measured every day, as was the amount of current flowing. Measurements for all samples are given after 180 days. The results are set forth in Table 6 below:

TABLE 6 corrosion rates with inhibitor, CP-2 and no EP-2

| Indent. | Conc. μA | CD $mA/m^2$ | Corr rate μm/year | Eff. % |
|---|---|---|---|---|
| $A^1$ | 10 | 45 | 36 | 81 |
| $A^1$ | 10 | 60 | 7 | 96 |
| $A^1$ | 20 | 31 | 40 | 79 |
| $A^1$ | 20 | 38 | 8 | 96 |

$A^1$ is an equimolar mixture of $ZnSO_4$ and $NaH_2PO_4$

Comparing the results above to those obtained with samples in which CP-2 was not turned off (see Table 6) it is evident that comparable efficiencies are obtained at comparable current densities.

EXAMPLE 2

In a second embodiment of the invention, the effect of using current to drive inhibitor cations into the concrete combined with impressed current CP-2, preconditioned samples are taken out of the chamber and treated as follows:

1. The samples are immersed in an ionic inhibitor solution EL-2 having the stated concentration.
2. $E_c$ is measured every day and direct current EP-2 is turned on when $E_c$ could be measured.
3. After EP-2 decreased by a factor of 5 it remained relatively constant; CP-2 is then turned on, and it remains on until a 10-fold decrease was measured; at this point $E_c$ remained relatively constant. Additional inhibitor solution EL-2 was charged to the container when CP-2 was found to have doubled. The frequency with which EL-2 is replenished depends upon how long it takes for CP-2 to double. EP-2 is turned off. The potential $E_p$ of CP-2 was measured every day, as was the amount of current flowing. Measurements for all samples are given after 180 days. The results are set forth in Table 7 below:

TABLE 7 corrosion rates with inhibitor, EP-2 and CP-2

| Ident. | Conc. μA | EP-2 μA | CD mA/m² | Corr rate μm/year | Eff. % |
|---|---|---|---|---|---|
| A[1] | 10 | 50–100 | 40 | 37 | 79 |
| A | 10 | 50–100 | 52 | 8 | 96 |
| A | 20 | 50–100 | 25 | 43 | 77 |
| A | 20 | 50–100 | 36 | 9 | 95 |

A[1] is an equimolar mixture of $ZnSO_4$ and $NaH_2PO_4$

EXAMPLE 3

In a third embodiment of the invention, to determine the effect of using an impressed current CP-2 to protect concrete thoroughly supplied with inhibitor EL-2, then subjecting the treated samples to contamination with saline EL-1 combined with impressed current CP-3, samples are treated as follows:

1. The samples are immersed in an ionic inhibitor solution EL-2 having the stated concentration.
2. $E_c$ is measured every day and impressed current CP-2 (impressed current in EL-2) is turned on when $E_c$ could be measured.
3. After CP-2 decreased by a factor of 8 it remained relatively constant; it is then turned off.
4. The inhibitor solution EL-2 is then replaced with saline solution EL-1 in which each sample is immersed.
5. Immediately thereafter, a "third impressed current" CP-3 (identified separately because it is delivered in EL-1) turned on.
6. The frequency of switching electrolytes and using CP-3 depends upon the time it takes for CP-2 to double.
5. The potential $E_p$ of CP-2 was measured every day, as was the amount of current flowing. Measurements for all samples are given after 180 days. The results are set forth in Table 8 below:

TABLE 8 corrosion rates with inhibitor and CP-2, then EL-1 and CP-3

| Ident. | Conc. μA | CD mA/m² | Corr rate μm/year | Eff. % |
|---|---|---|---|---|
| A[1] | 10 | 45 | 34 | 82 |
| A | 10 | 55 | 8 | 96 |
| A | 20 | 35 | 38 | 80 |
| A | 20 | 40 | 7 | 96 |

A[1] is an equimolar mixture of $ZnSO_4$ and $NaH_2PO_4$

Comparing the results above to those obtained with samples in which CP-2 was not turned off (see Table 9) it is evident that comparable efficiencies are obtained but the current densities in Table 9 are slightly lower than those required in Table 8 above.

EXAMPLE 4

In a fourth embodiment of the invention, preconditioned samples are taken out of the chamber and treated with the following steps:

1. The samples are immersed in an ionic inhibitor solution EL-2 having the stated concentration.
2. $E_c$ is measured every day and direct current EP-2 is turned on when $E_c$ could be measured.
3. After EP-2 decreased by a factor of 5 it remained relatively constant; CP-2 is then turned on, and it remains on until a 10-fold decrease was measured; at this point $E_c$ remained relatively constant. Additional inhibitor solution EL-2 was charged to the container when CP-2 was found to have doubled. The frequency with which EL-2 is replenished depends upon how long it takes for CP-2 to double. The potential $E_p$ of CP-2 was measured every day, as was the amount of current flowing. EP-2 is not turned off during the run. Measurements for all samples are given after 180 days. The results are set forth in Table 9 below:

TABLE 9 corrosion rates witb inhibitor, EP-2 and CP-2

| Ident. | Conc. μA | EP-2 μA | CD mA/m² | Corr rate μm/year | Eff. % |
|---|---|---|---|---|---|
| A[1] | 10 | 50–100 | 35 | 39 | 79 |
| A[1] | 10 | 50–100 | 50 | 8 | 96 |
| A[1] | 20 | 50–100 | 20 | 43 | 77 |
| A[1] | 20 | 50–100 | 35 | 9 | 95 |

A[1] is an equimolar mixture of $ZnSO_4$ and $NaH_2PO_4$

Comparing the results above to those obtained with samples which had first been given an electroosmotic treatment to remove contaminant anions (see Table 10) it is evident that the efficiencies obtained with inhibitor treatment as above, is comparable with those obtained when samples are given an additional preliminary electroosmotic treatment to remove contaminant anions.

EXAMPLE 5

In a fifth embodiment of the invention, two circuits for electroosmotic treatment with currents EP-1 and EP-2 are used sequentially, followed by cathodic protection with impressed current CP.

To begin, and during the treatment, the corrosion potential $E_c$ of the rebars is continually monitored with the reference electrode. The steps for each run are set forth below:

1. The specimen is immersed in saline solution EL-1, and $E_c$ is measured.
2. When $E_c$ can be measured, "first" current EP-1 is turned on to deplete the concentration of corrosive anions in the concrete.
3. EP-1 is switched off after current flow is found to have decreased at least two-fold, preferably from three- to five-fold.
4. Promptly, and preferably immediately thereafter, the saline solution EL-1 is replaced with a solution of ionizable inhibitor EL-2.
5. "Second" current "EP-2" is turned on to drive cations of the inhibitor into the concrete.
6. EP-2 is switched off after current is found to have decreased at least two-fold, preferably from three- to ten-fold.

7. With the sample immersed in EL-2, CP is turned on; CP is maintained until its current density (CD) decreases by at least 50%, preferably by a factor of 2 and most preferably by an order of magnitude, that is, ten-fold; when the CD remains substantially the same at the decreased level, additional inhibitor solution EL-2 is charged, preferably enough to double the current EP-2.
8. Addition of EL-2 repetitively depends upon how long it takes before the current density CD of CP doubles.

Corrosion Rate and Current Density Were Calculated

After only three days $E_c$ is difficult to measure meaningfully but after about 10 days it is found to be about −360 mV and remains substantially constant irrespective of which sample the rebar is embedded. The $E_c$ is reported relative to a standard hydrogen electrode.

Finally, for comparison, in the sixth series of experiments, samples which had been electroosmotically cleaned with EP-1 while immersed in EL-1, were then subjected to a combination of direct EP-2 current at 36 V and a second impressed current CP-2 (identified separately because it is provided in combination with EP-2). CP-2 is provided at numerically greater potential than the corrosion potential measured at $E_c$ (typically about −360 mV) at voltage of about 50 V. Note that "second CP-2" will be different from "first CP-1". Measurements for all samples are given after 180 days. The results are set forth in Table 10 below:

TABLE 10 corrosion rates with inhibitor, EP-2 and CP-2

| Ident. | Conc. μA | EP-2 μA | CD mA/m² | Corr rate μm/year | Eff. % |
|---|---|---|---|---|---|
| A[1] | 10 | 50–100 | 16 | 31 | 83 |
| A | 10 | 50–100 | 25 | 8 | 98 |
| A | 20 | 50–100 | 8 | 26 | 86 |
| A | 20 | 50–100 | 11 | 9 | 95 |
| B[2] | 10 | 40–70 | 20 | 6 | 82 |
| B | 10 | 40–70 | 30 | 6 | 97 |
| B | 20 | 40–70 | 10 | 38 | 75 |
| B | 20 | 40–70 | 20 | 8 | 96 |
| C[3] | 10 | 30–80 | 25 | 30 | 80 |
| C | 10 | 30–80 | 35 | 6 | 97 |
| C | 20 | 30–80 | 20 | 32 | 83 |
| C | 20 | 30–80 | 25 | 6 | 97 |

A[1] is an equimolar mixture of $ZnSO_4$ and $NaH_2PO_4$
B[2] is an organic nitrite
C[3] is an organic aminophosphite It is evident from the above that, with a combination of EP-2 and CP-2, the effectiveness of the inhibitor is much greater than protection by removal of corrosive anions using direct current EP-1 followed by cathodic protection with impressed current CP-1; and more effective than a double-barreled electroosmotic treatment, first, EP-1 to remove harmful anions; then EP-2 to drive inhibitor ions into the concrete.

What is claimed is:

1. A method of treating a steel-reinforced concrete structure to impregnate it with inhibitor cations comprising, measuring the corrosion potential of the steel, placing a primary anode adjacent an outer surface of the reinforced concrete structure, supplying the primary anode with an aqueous solution of an inhibitor for reinforced concrete and substantially saturating the structure with the inhibitor solution, applying a direct impressed cathodic current, at a chosen first voltage non-injurious to humans, between the primary anode and the steel in the structure at a potential in the range from 50 mV to about 350 mV numerically greater than the corrosion potential measured, maintaining the impressed current until flow is relatively constant at a level at least one-half the level at which the impressed current was initiated.

2. The method of claim 1 wherein the structure is continuously supplied with inhibitor solution.

3. The method of claim 1 comprising, providing a secondary cathode and a secondary anode adjacent the structure, applying a direct first electroosmotic current at a chosen second voltage non-injurious to humans, between the secondary anode and the secondary cathode at a level sufficient to drive cations of the inhibitor into the concrete and maintaining the second voltage of the first electroosmotic current until the flow of current decreases at least by one-half; and, thereafter applying the direct impressed cathodic current at a chosen first voltage non-injurious to humans, between the primary anode and the steel in the structure at a potential in the range from 50 mV to about 350 mV numerically greater than the corrosion potential measured.

4. The method of claim 3 including, switching off the first electroosmotic current when flow decreases at least by one-half, thereafter applying the direct impressed cathodic current and maintaining the current at the chosen first voltage until its flow decreases by at least one-half.

5. The method of claim 3 including, prior to applying the direct first electroosmotic current, continuously supplying the concrete with an aqueous electrolyte while applying a direct second electroosmotic current at a chosen third voltage non-injurious to humans, between the secondary anode and the secondary cathode at a level sufficient to remove contaminant anions in the concrete, and, maintaining the third voltage of the second electroosmotic current until the flow of current decreases at least by one-half.

6. The method of claim 1 including, thereafter, switching off the first impressed cathodic current, discontinuing contact with the concrete of the inhibitor solution, continuously supplying the concrete with an aqueous electrolyte while applying a direct second impressed cathodic current, at a chosen first voltage non-injurious to humans, between the primary anode and the steel in the structure at a potential in the range from 50 mV to about 350 mV numerically greater than the corrosion potential measured.

* * * * *